United States Patent [19]

Hahn

[11] Patent Number: 4,929,203

[45] Date of Patent: May 29, 1990

[54] MARINE PROPELLER DRIVE SYSTEM

[75] Inventor: Steven C. Hahn, Mt. Clemens, Mich.

[73] Assignee: GKN Automotive, Inc., Auburn Hills, Mich.

[21] Appl. No.: 397,378

[22] Filed: Aug. 22, 1989

Related U.S. Application Data

[63] Continuation of Ser. No. 163,778, Mar. 8, 1988, abandoned.

[51] Int. Cl.[5] ..... B63H 25/42

[52] U.S. Cl. ..... 440/75; 440/51; 440/57; 440/78

[58] Field of Search ..... 440/53, 57, 61, 76, 440/78, 75, 83; 464/903

[56] References Cited

U.S. PATENT DOCUMENTS

| | | | |
|---|---|---|---|
| 3,209,720 | 10/1965 | Campbell et al. | 440/83 |
| 3,368,516 | 2/1968 | MacDonald et al. | 440/75 |
| 3,654,889 | 4/1972 | Bergstedt | 440/57 |
| 3,933,116 | 1/1976 | Adams et al. | 440/61 |
| 3,976,027 | 8/1976 | Jones | 440/61 |
| 4,541,819 | 9/1985 | Mazziotti | 464/906 |
| 4,544,362 | 10/1985 | Arneson | 440/61 |
| 4,608,028 | 8/1986 | Welschof et al. | 464/906 |
| 4,728,308 | 3/1988 | Weismann | 440/83 |

FOREIGN PATENT DOCUMENTS

| | | | |
|---|---|---|---|
| 2092973 | 8/1982 | United Kingdom | 440/61 |

*Primary Examiner*—Sherman D. Basinger
*Assistant Examiner*—Thomas J. Brahan
*Attorney, Agent, or Firm*—Remy J. VanOphem

[57] ABSTRACT

A propeller drive system for marine applications having a constant velocity universal joint for articulating the propeller shaft without transmitting the propeller thrust therethrough, the propeller thrust being delivered to the boat hull in line with an inner propeller shaft. The inner propeller shaft is gearingly connected to a marine power plant located within the boat, exits from the boat and connects to the inner race of the constant velocity universal joint. An outer propeller shaft connects to the outer race of the constant velocity universal joint and ends at the propeller. In order that the constant velocity universal joint serve to transmit rotational torque and permit articulation of the outer propeller shaft relative to the inner propeller shaft without propeller thrust being transmitted therethrough, thrust from the propeller is directed by thrust bearings to an inner and outer thrust housing, thereby bypassing the inner race member of the constant velocity universal joint and the inner propeller shaft. The inner thrust housing includes an annulus inside of which is located the inner propeller shaft, resulting in propeller thrust being delivered to the boat in line with the inner propeller shaft. Steering is accomplished by rotation of a steering shaft, which turns the outer thrust housing and the outer propeller shaft. The marine propeller drive system may be mounted at the transom or at the hull.

25 Claims, 4 Drawing Sheets

MARINE PROPELLER DRIVE SYSTEM

This is a continuation of application Ser. No. 07/163,778, filed March 8, 1988 now abandoned.

BACKGROUND OF THE INVENTION

1. Field of the Invention

This invention relates to marine propeller drive systems for boats and, more particularly, to a marine propeller drive system having an articulated propeller shaft incorporating a constant velocity joint.

2. Description of the Prior Art

Over the years, three systems have become preferred for marine propeller drive systems. These are known as "outboard", "inboard-outdrive" and "inboard" propeller drive systems. Each of these have distinct operating features and characteristics that determine which of these is the system of choice for a particular application.

The outboard propeller drive system has a self-contained motor and drive train for the propeller which is mounted aft of the boat, onto a specially adapted mounting structure built into the transom. It has the advantage of easy servicing, as the motor can be easily removed from the boat. More importantly, it has the advantage that the unit as a whole rotates when a turn is initiated. This means that the propeller thrust axis is caused to rotate into the turn, which greatly improves handling at low speeds and makes single propeller maneuvering when in reverse relatively easy. The outboard propeller drive system, however, has the disadvantage of being expensive because of mechanical complexity. Further, it is inefficient because a substantial structure is located below the water surface, resulting in viscous drag. Additionally, the point of contact of the propeller drive system with the boat is at a location on the transom high above the hull, resulting in thrust from the propeller drive system not being aligned with the hull. Finally, these outboard propeller drive systems tend to add considerable weight aft of the transom, frequently resulting in difficulty in achieving proper planing of the boat at low to moderate speeds of operation.

The inboard-outdrive propeller drive system has the motor contained in the boat itself, but the propeller drive mechanism is contained in an external outdrive unit which is aft of the transom. Generally, the external outdrive unit is secured to the transom and articulates relative thereto, functioning much like the propeller drive of an outboard propeller drive system. The inboard-outdrive propeller drive system has the advantage that commercially available engines, after marine modification, may be used, thus, substantially reducing costs. Further, because the external outdrive unit rotates when a turn is initiated, the propeller thrust axis rotates, as in the outboard propeller drive system, thus, greatly enhancing low speed and reverse maneuvering capability.

There are numerous examples of inboard-outdrive propeller drive systems. U.S. Pat. No. 3,136,287 to North is exemplary of an inboard outdrive, and also generally exemplary of the complex mechanical linkage frequently associated with inboard-outdrive propeller drive systems. North attaches his external outdrive unit to a tiltable intermediate member which is in turn attached to the transom. A universal joint allows tilting and steering of the external outdrive unit. Many other inboard-outdrive propeller drive systems have been developed, including U.S. Pat. No. 3,368,516 to MacDonald et al which utilizes a constant velocity joint; U.S. Pat. No. 3,368,517 to MacDonald et al which utilizes a Cardan universal joint; U.S. Pat. No. 3,382,838 to Bergstedt which utilizes an inclined drive shaft and bevel gear; and U.S. Pat. No. 3,826,219 to Nossiter which utilizes a drive transmission that permits articulation without use of universal joints. U.S. Pat. No. 3,487,804 to Kiekhaefer is of interest to show an improved inboard-outdrive propeller drive system incorporating an air stream at the propeller to reduce viscous drag. The inboard-outdrive retains many of the advantages of the outboard, while retaining essentially all of its disadvantages, as enumerated above.

The inboard propeller drive system has the motor and transmission entirely contained within the boat. Most commonly, a propeller shaft exits from the hull forward of the transom and angles downwardly to a point near the transom. In these systems, the propeller shaft is not articulated, and the propeller is retained in a fixed relationship with respect to the hull. Because of the fixed position of the propeller, it is very difficult, if not impossible, to steer the boat when operating at low speeds or in reverse. To solve this problem, it is well known in the art to provide two spaced apart propeller shafts. By operating the propeller shafts at different angular velocities, it is possible for the skipper to achieve a torque couple that will steer the boat. While a second propeller shaft can aid low speed and reverse maneuverability, it is expensive and is not generally as maneuverable as the inboard and inboard-outdrive propeller drive systems. Inboard propeller drive systems have the advantage of utilizing conventional motors and transmissions which are adapted for marine use, thus, reducing the expense of these components. Further, the torque axis generated by the propeller is generally in line with and directed onto the hull, thereby greatly aiding the performance characteristics of the boat.

One form of the present invention relates to inboard propeller drive systems that incorporate propeller shafts which exit the boat through the transom. A particular case in point is an inboard propeller drive system for surface effect propellers. Surface effect propellers are utilized in high performance boat applications, where it has been found that the propeller efficiency is highest when it operates partially out of the water. Accordingly, in these surface effect propeller drive systems, the propeller shaft is located on the transom near the waterline. An example of a surface effect propeller drive system is U.S. Pat. No. 3,933,116 to Adams et al. Adams et al disclose a marine propeller drive system having an articulatable propeller shaft incorporating a double-Cardan universal joint, a propeller cover, and a thrust bearing box for the propeller shaft. The propeller is able to articulate in the vertical as well as the horizontal directions. Propeller thrust is transferred to the transom at the attachment location of the thrust bearing box. A second example of a surface effect propeller drive system is U.S. Pat. No. 4,565,532 to Connor. Connor discloses an articulatable propeller shaft incorporating a double-Cardan universal joint, a gimbal ring mounting for the propeller shaft and a vertically stacked gear box. The gear box requires extensive structure aft of the transom. Propeller thrust is transferred to the transom where the gear box attaches to the transom. Both the Adams et al and Connor marine propeller drive systems involve complicated structures, requiring disposition of the propeller far aft of the transom. Further, the mounting and drive structures of the Adams et al and Connor marine propeller drive systems require mounting to the transom, thereby precluding operation in situations involving conventional inboard marine propeller systems where the shaft is mounted under the hull. Additionally, the Adams et al and Connor marine propeller drive systems utilize double-Cardan universal joints which, although sometimes referred to incorrectly as "constant velocity universal joints" are not actually constant velocity universal joints as shaft vibration is present caused by speed variations in the joint. Finally, the Adams et al and Connor marine propeller drive systems deliver propeller thrust generally onto the transom, an undesirable feature, since for best performance and maneuverability, propeller thrust should be delivered to the boat at the hull, in line with the propeller shaft.

Hence, there remains in the art the need to provide an inboard propeller drive system which has the capability of providing the maneuverability of outboard and inboard-outdrive propeller drive systems, while substantially retaining the external structural simplicity and hull directed propeller thrust delivery of conventional inboard propeller drive systems. There further remains in the prior art the need to provide the aforesaid maneuverability and hull directed propeller thrust delivery utilizing a true constant velocity universal joint, as exemplified by the Rzeppa type.

SUMMARY OF THE INVENTION

The present invention is a marine propeller drive system incorporating a true constant velocity universal joint for articulating the propeller shaft, wherein the constant velocity universal joint transmits torque to the propeller, while none of the propeller thrust is transmitted therethrough. Further, the present invention is structured to direct propeller thrust in line with the propeller shaft so that propeller thrust may be delivered to the boat at the hull.

An inner propeller shaft connects at one end to the engine transmission at a location within the boat. The inner propeller shaft connects at the other end to the inner race of a constant velocity universal joint. An outer propeller shaft connects at one end to the outer race of the constant velocity universal joint, the propeller being connected to the other end thereof.

Thrust produced by rotation of the propeller is directed by the outer propeller shaft to thrust bearings. The thrust bearings transfer the propeller thrust to an outer thrust housing which generally surrounds, but does not contact, the outer race of the constant velocity universal joint. The propeller thrust is then directed to an inner thrust housing having an annulus in which the inner propeller shaft is located.

Steering is accomplished by rotation of a steering shaft having connection to the outer thrust housing. When the outer thrust housing is rotated, the thrust bearing causes the outer propeller shaft to rotate as well.

Thus, with the structure of the present invention, the propeller shaft is articulated by incorporation of a true constant velocity universal joint; further, propeller thrust is routed around the constant velocity universal joint and directed axially in line with the inner propeller shaft. Because of these structural features, the propeller thrust is transferred directly to the hull of the boat, rather than the transom. Further, the present invention may be mounted through either the transom or at the hull, the latter being the practice in conventional inboard propeller drive systems.

Accordingly, it is an object of the present invention to provide a marine propeller drive system having an articulated propeller shaft incorporating a true constant velocity universal joint.

It is a further object of the present invention to provide a marine propeller drive system having an articulated propeller shaft incorporating a true constant velocity universal joint including provision for a thrust housing for routing propeller thrust around the constant velocity universal joint and directing that thrust coaxially with respect to an inner portion of the propeller shaft.

It is yet a further object of the present invention to provide a marine propeller drive system which permits propeller shaft articulation and directs propeller thrust to the hull.

It is still another object of the present invention to provide a compact, uncomplicated, vibration free marine propeller drive system having an articulated propeller shaft, the marine propeller drive system being mountable either through the transom or through the hull.

These and other objects, advantages, features, and benefits of the present invention will become apparent from the following specification.

DETAILED DESCRIPTION OF THE PREFERRED EMBODIMENT

Figure 1:
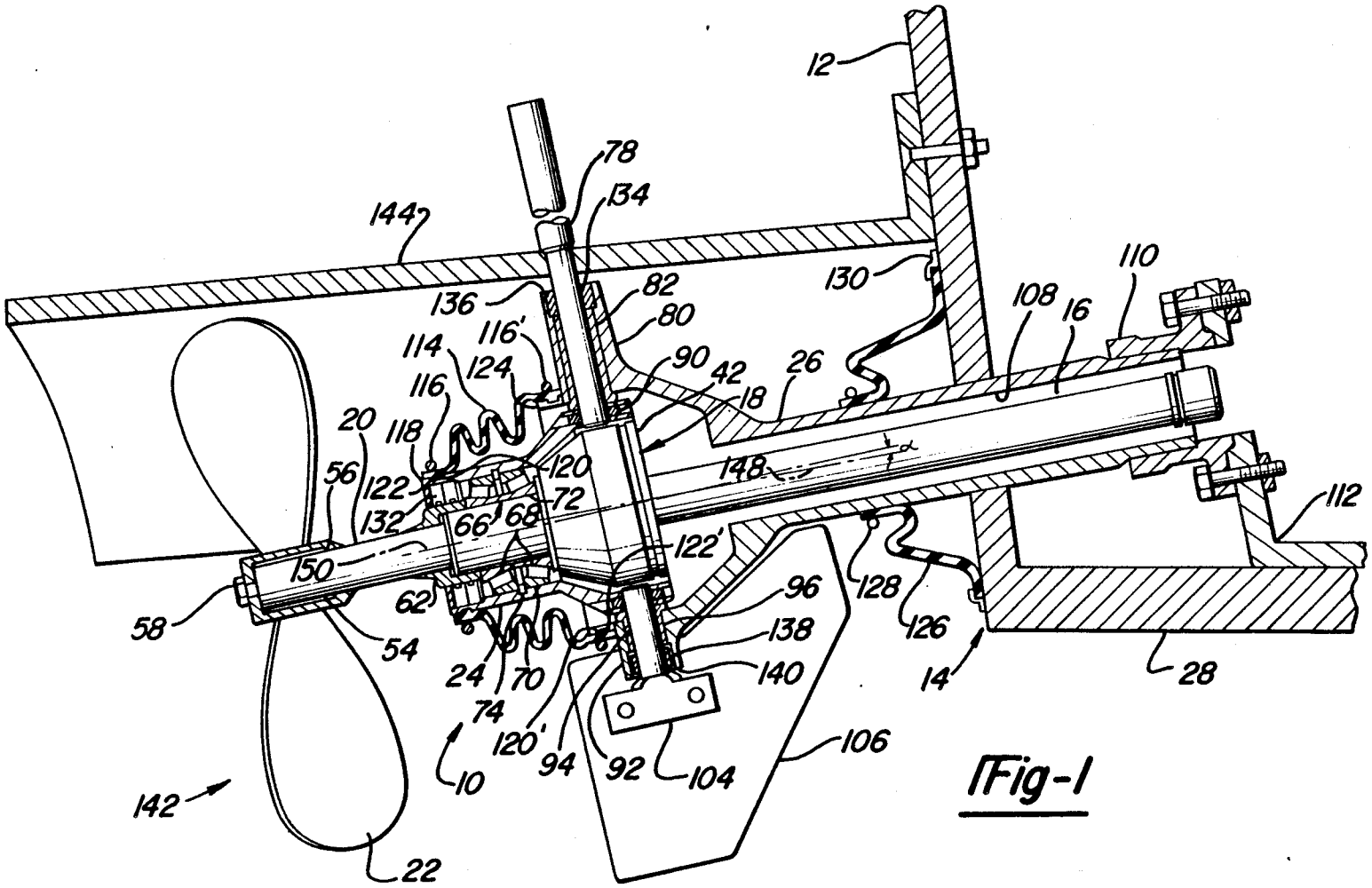
FIG. 1 is a part sectional side view of the present invention in operation, mounted through a boat transom.

Referring now to the figures, FIG. 1 shows a marine propeller drive system 10 according to the present invention mounted through a transom 12 of a boat 14. The marine propeller drive system 10 has an articulated propeller shaft including a fixed position inner propeller shaft 16, a constant velocity universal joint 18 and a pivotable outer propeller shaft 20. Thrust from a propeller 22 is transferred to an outer thrust housing 24, an inner thrust housing 26 and, finally, to the boat hull 28.

Referring now to FIGS. 1 through 5, the structure of the marine propeller drive system may be understood. The inner propeller shaft 16 is connected at one end to a conventional marine power plant including an engine and transmission (not shown) which are located within the boat 14. As may be best seen from FIG. 2, the inner propeller shaft connects at its other end to an inner race member 30 of the constant velocity universal joint 18.

Figure 2:
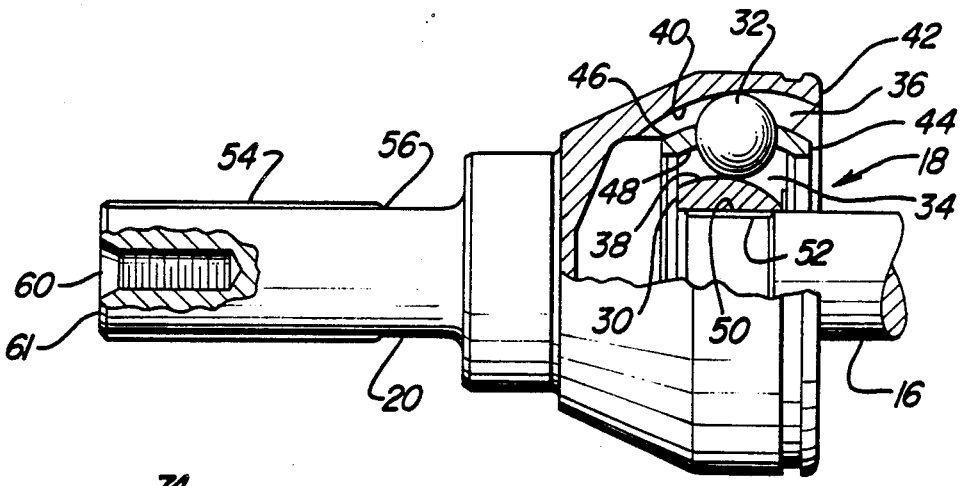
FIG. 2 is a fragmentary part sectional side view of the constant velocity joint of the present invention.

The constant velocity universal joint 18 is preferably, but not requisitely, of the type represented by U.S. Pat. Nos. 1,665,280 and 2,046,584 both issued to Alfred Rzeppa. This type of universal joint has the superior advantage that the speed of rotation of the shaft connected with the inner race member is the same as the shaft connected with the outer race member, regardless of the relative angular position between the inner and outer race members, within a predetermined range of relative angular positions. Referring to FIG. 2, the constant velocity universal joint 18 transmits torque through a plurality of spherical ball members 32 (one being shown in FIG. 2). These spherical ball members revolve in sets of opposing axial grooves 34 and 36 formed, respectively, on a partially spherical surface 38 of the inner race member 30 and a partially spherical surface 40 of the outer race member 42. Ball guide means, in the form of a cage 44, are positioned to capture and guide the spherical ball members through a homokinetic plane of rotation wherein the centers of the spherical ball members bisect the articulation angle between the spherical surfaces of the inner and outer race members, resulting in a constant velocity of rotary motion without vibration. The ball cage normally consists of outer and inner partially spherical surfaces 46 and 48, which are guided, respectivelyl, on the aforesaid partially spherical surfaces of the outer and inner race members, with radial clearance therebetween in order to ensure the presence of adequate lubrication.

The inner propeller shaft 16 connects with the inner race member 30 by interaction of straight splines 50 and 52, respectively, on the inner propeller shaft and on the inner race member 30. The outer propeller shaft 20 is connected integrally with the outer race member 42. An end 61 of the outer propeller shaft has the propeller 22 removably attached thereto in a conventional manner. Specifically a conventional propeller has axially located splines within a mounting bore for being received on the propeller shaft. Splines 54 on an outer surface 56 of the outer propeller shaft 20 and a bolt 58 (shown in FIGS. 1 and 5) which is threadingly received in an axially blind bore 60 in the end 61 of the outer propeller shaft removably attach the propeller to the outer propeller shaft 20.

When the propeller rotates, it will generate thrust which will be delivered to the outer propeller shaft 20. The constant velocity universal joint 18 cannot accept, through its internal components, axial thrust of this magnitude. Accordingly, the present invention includes a structure which routes propeller thrust around the constant velocity universal joint, the constant velocity universal joint interacting with the outer propeller shaft 20 only to deliver rotational torque thereto.

Figure 4:
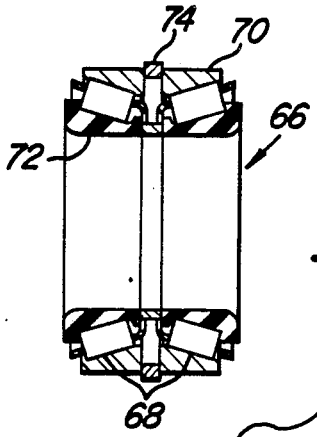
FIG. 4 is a part sectional side view of the thrust bearing according to the present invention.
Figure 3:
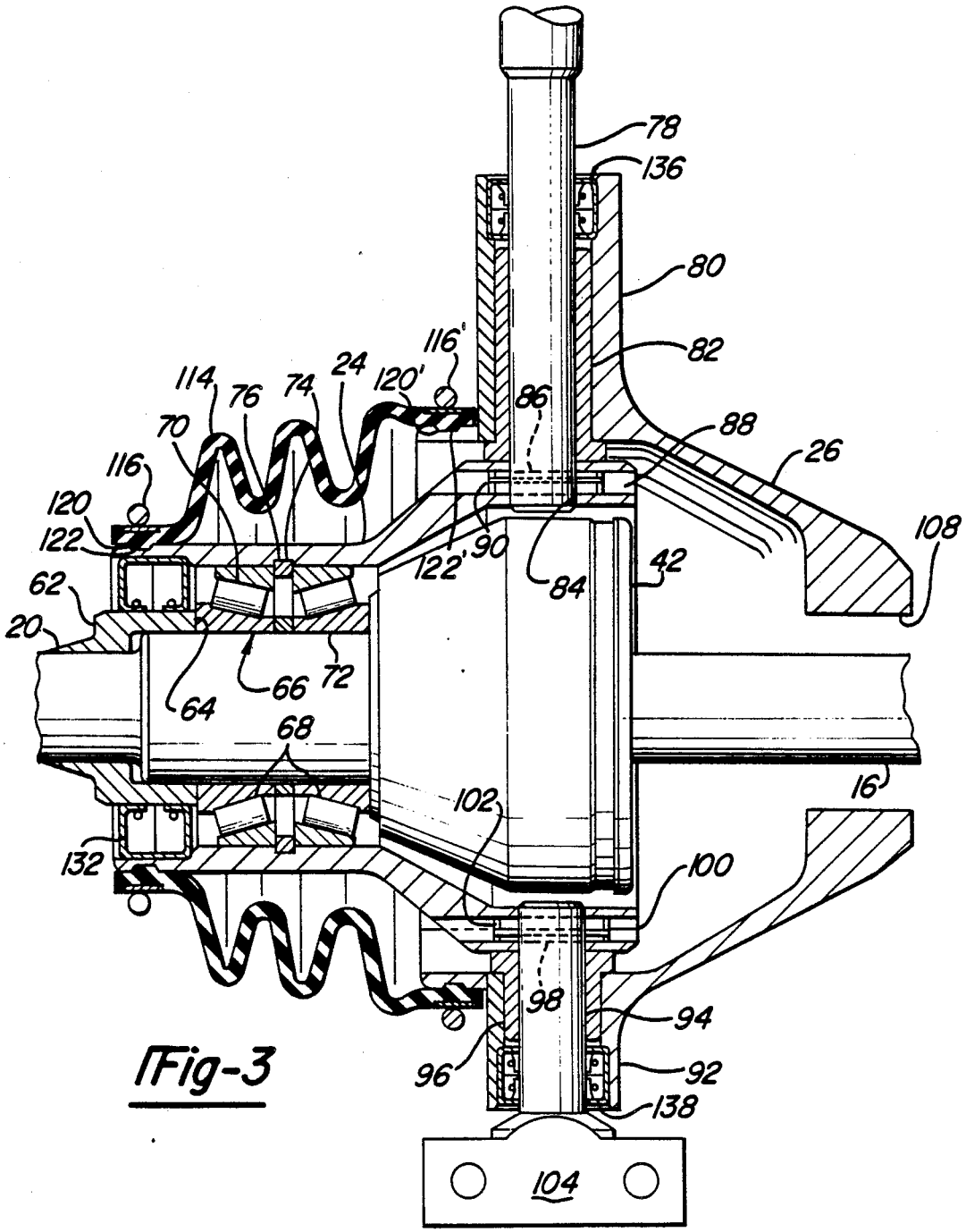
FIG. 3 is a detailed fragmentary part sectional side view of the present invention.

Referring now to FIGS. 1, 3 and 4, the structure to accomplish routing of the axial thrust is shown. A thrust ring 62 is welded to the outer propeller shaft 20. The thrust ring has a shoulder 64 which abuts a thrust bearing 66. The thrust bearing is preferably a conventional type "SS" two row bearing assembly, shown particularly in FIG. 4. The type "SS" two row bearing assembly utilizes a high volume type TS bearing 68 with a snap ring cup spacer 70 in a rolled ring cup spacer 72. The snap ring cup spacer 70 has a snap ring 74 which inter-fits within a recess 76 of the outer thrust housing 24. Thus, axial thrust from the propeller 22 is transmitted along the outer propeller shaft 20 to the thrust ring 62 to the type "SS" two row bearing assembly and, finally, to the outer thrust housing via the snap ring.

A steering shaft 78 is connected in a conventional manner to a conventional steering control (not shown). Preferably, the conventional steering control is of the type including a hydraulic cylinder and a tie rod which interfaces with the steering shaft, the hydraulic cylinder being actuated by movement of a steering wheel on the boat, the steering shaft, in kind, rotating with rotation of the steering wheel. The steering shaft inserts into a steering shaft hub 80 of the inner thrust housing 26, and rotates on a sleeve 82 within the steering shaft hub. The steering shaft 78 protrudes through the inner thrust housing into a steering shaft aperture 84 in the outer thrust housing. The steering shaft 78 has a bore 86 and the outer thrust housing 24 also has a bore 88 into which a pin 90 is inserted. The pin 90 cooperates with the bores 86 and 88 to cause the outer thrust housing 24 to rotate with rotation of the steering shaft 78.

Oppositely located on the inner thrust housing 26 from the steering shaft hub 80, is a skag plate hub 92. A skag plate shaft 94 is rotatably mounted in the skag plate hub, the skag plate shaft rotating on a sleeve 96 within the skag plate hub. The skag plate shaft protrudes through the inner thrust housing in the manner hereinabove described for the steering shaft 78. Specifically, a bore 98 in the skag plate shaft 94 and a bore 100 in the outer thrust housing accommodate a pin 102 inserted thereinto. Accordingly, when the outer thrust housing rotates in response to rotation of the steering shaft, the skag plate shaft similarly rotates. A mount 104 is included on the skag plate shaft 94 for mounting a skag plate 106 (shown in FIG. 1) thereto. The skag plate aids accomplishing directional movement of the propeller in response to steering shaft rotation, in a manner well known in the art.

Referring again to FIG. 1, the inner thrust housing 26 has an annulus 108 into which the inner propeller shaft is located. The inner thrust housing enters the boat at the transom and then terminates in a connection member 110 which connects in a well known manner with a retaining structure 112 that is preferably anchored to the hull 28 of the boat. Accordingly, propeller thrust is delivered to the boat structure in a manner which is characteristic of a marine propeller drive system having only a propeller shaft transfer of thrust to the boat, yet the constant velocity universal joint and the inner propeller shaft have been spared subjection to the propeller thrust.

It is preferred that the interior of the inner and outer thrust housing be lubricant filled to ensure full and proper lubrication of the constant velocity universal joint. This may include connection in a conventional manner to an oil pump system well known in the art.

Boots and seals are provided to ensure hydraulic integrity of the marine propeller drive system 10 according to the present invention. A steering boot 114, constructed of a pleated, resilient material, is secured by a first snap ring 116 to one end 118 of the outer thrust housing 24, a recess 120 being provided for inter-fitting of a nib 122 of the steering boot. The steering boot is secured at its other end in the manner previously recited to a boot ring 124, the boot ring being attached to the base of both the steering shaft hub 80 and the skag plate hub 92, specifically, a snap ring 116', recess 120' and nib 122' are used therefor. An optional transom boot 126 is provided to seal the entry location of the inner thrust housing 26 into the transom 12. A snap ring 128 is used to secure the transom boot to the inner thrust housing; a nib and cooperating recesses hereinabove described could be used as well if desired. The transom boot may be sealed with respect to the transom using a compression fit or a clip ring 130 which is itself secured to the transom. An outer housing lip seal 132 is located between the outer thrust housing 24 and the thrust ring 62. A steering shaft seal 134 is provided at the end 136 of the steering shaft hub 80; likewise, a skag plate shaft seal 138 is provided at the end 140 of the skag plate hub 92.

Figure 5:
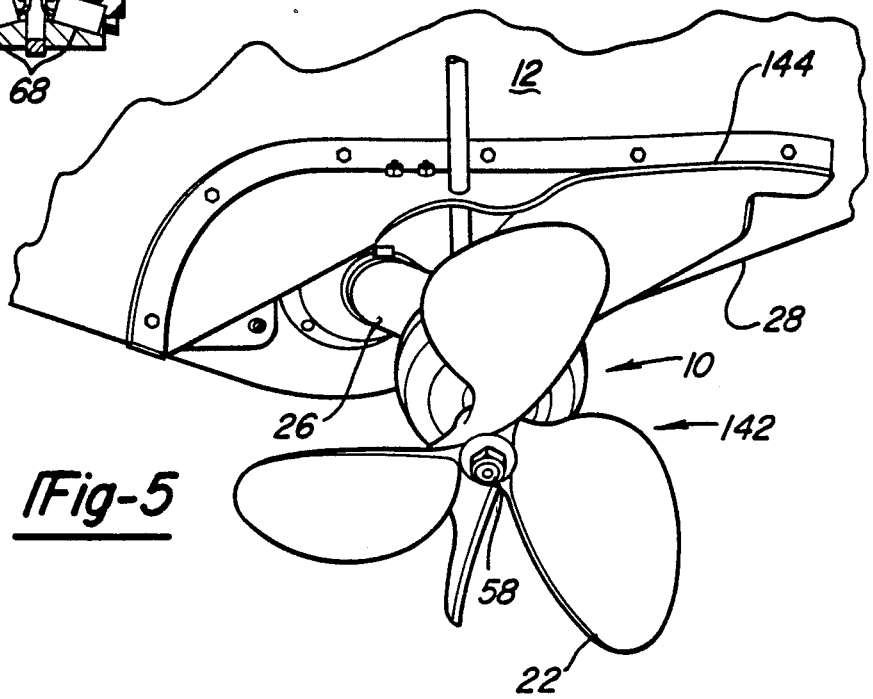
FIG. 5 is an end view of the present invention in operation as in FIG. 1.

FIG. 5 shows the marine propeller drive system 10 according to the present invention seen from the rear of the boat 14. In this figure, the propeller has been directed off angle from the axis of the inner propeller shaft during a turning maneuver.

Figure 6:
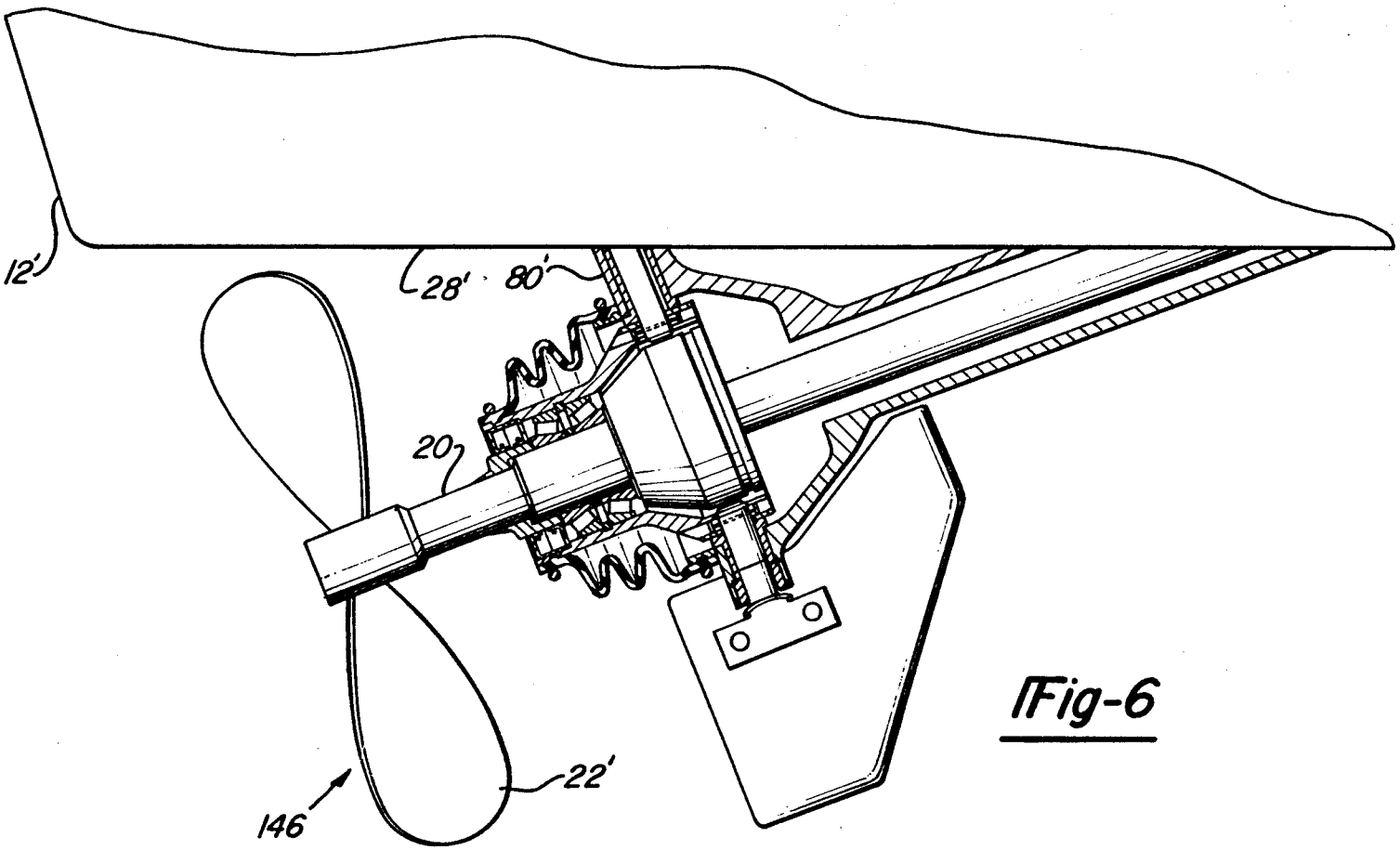
FIG. 6 is a part sectional side view of the present invention in operation, mounted through a boat hull.

The operational configuration 142 as shown in FIGS. 1 and 5 is a surface effect propeller inboard marine propeller drive system. As indicated hereinabove, a surface effect propeller 22 is used in high performance applications in which a portion of the propeller is out of the water. Accordingly, a propeller cover 144 is provided which may or may not be mounted so as to follow directional changes in the outer propeller shaft. The operational configuration 146 shown in FIG. 6 is for a conventionally located propeller inboard marine propeller drive system. A conventional propeller 22' is structured for operation entirely submerged. It will be seen that the standard propeller shaft mounting structure used in conventional inboard marine propeller drive systems may be replaced by a steering shaft hub 80'. Thus, in this operational configuration 146, the marine propeller drive system according to the present invention is mounted to the hull 28', the transom 12' being free of any attachments thereto. The components hereinabove described for the operational configuration 142 shown in FIGS. 1 through 5 apply equally for the operational configuration 146 shown in FIG. 6.

It is preferred that there be a slight angular variation between the axis of rotation 148 of the inner propeller shaft in relation to the axis of rotation 150 of the outer propeller shaft, in order that the constant velocity universal joint be continuously in movement, thereby stirring lubricants therein contained.

In operation, torque is delivered from a conventional marine power plant to the inner propeller shaft. The torque then transfers through the constant velocity universal joint through the outer propeller shaft and, finally, to the propeller. Thrust from the propeller is directed from the outer propeller shaft to a thrust ring, to a thrust bearing, to the outer thrust housing, to the inner thrust housing and, finally, to the boat hull in coaxial alignment with the inner propeller shaft. Propeller thrust applied to the outer propeller shaft, which communicates to the outer race member 42 of the constant velocity universal joint 18, is not transferred to the inner race member 30 and the inner propeller shaft 16 because the inner propeller shaft is axially slidable via the splines 50 and 52 while propeller thrust is directed to the outer and inner thrust housing. Steering is accomplished by rotating the steering shaft through a conventional steering linkage connected to a steering wheel, as is well known in the art. When the steering shaft rotates, the outer thrust housing rotates, causing the outer propeller shaft to rotate similarly. Further, the skag plate shaft is caused to rotate similarly as well. The skag plate offers hydraulic resistance during the aforesaid rotation of the steering shaft, thereby aiding steering of the boat.

It will be appreciated, therefore, that the marine drive propeller system according to the present invention will provide for maneuvering at low forward speeds and in reverse speeds with only one propeller drive being required, the propeller drive delivering thrust directly to the hull of the boat.

To those skilled in the art to which this invention appertains, the above described preferred embodiment may be subject to change or modification. Such changes or modifications can be carried out without departing from the scope of the invention, which is intended to be limited only by the scope of the appended claims.

What is claimed is:

1. A marine propeller drive system for a boat having a power plant and a propeller comprising:

an inner propeller shaft having a first end connectable to said power plant and a second end;

a constant velocity universal joint having a first end connected to said second end of said inner propeller shaft, said universal joint having a second end articulatable with respect to said first end about an articulation axis;

an outer propeller shaft having a first end connected to said second end of said universal joint and a second end connectable to said propeller;

an inner thrust housing having a first end connected to said boat and a second end adjacent to said universal joint, said inner thrust housing enclosing at least a portion of said inner propeller shaft;

an outer thrust housing pivotably connected to said second end of said inner thrust housing about a vertical pivot axis coincident with said articulation axis, said outer thrust housing rotatably supporting said outer propeller shaft;

a thrust bearing connected between said outer propeller shaft and said outer thrust housing transferring the axial forces generated by said propeller on said outer propeller shaft to said outer thrust housing;

a skag plate connected to said outer thrust housing and pivotable therewith, said skag plate extending downward from said outer thrust housing and forward of said vertical pivot axis; and means for angularly displacing said outer thrust housing with respect to said inner thrust housing about said vertical pivot axis.

2. The marine propeller drive system of claim 1, wherein said means for angularly displacing comprises:

a steering hub provided on said inner housing; and a steering shaft rotatably mounted to said steering shaft hub concentric with said vertical pivot axis, said steering shaft having one end fixedly connected to said outer thrust housing.

3. The marine propeller drive system of claim 2, wherein said boat has a hull and a transom, said first end of said inner thrust housing extends through said transom and is connected to said hull.

4. The marine propeller drive system of claim 3, wherein said universal joint has an inner race member and an outer race member, said inner race member is connected with said second end of said inner propeller shaft and said outer race member is connected with said first end of said outer propeller shaft.

5. The marine propeller drive system of claim 2, wherein said inner thrust housing extends through the bottom of said hull.

6. The marine propeller drive system of claim 5, wherein said universal joint has an inner race member and an outer race member, said inner race member is connected with said second end of said inner propeller shaft and said outer race member is connected with said first end of said outer propeller shaft.

7. A marine propeller drive system for a boat, said boat having a hull, a marine power plant and a propeller for producing thrust, comprising:

an inner propeller shaft having a first end and a second end, said first end of said inner propeller shaft being connectable to said marine power plant;

a constant velocity universal joint having an inner race member and an outer race member, one of said inner race member and said outer race member being connected with said second end of said inner propeller shaft;

an outer propeller shaft having a first end and a second end, said first end of said outer propeller shaft being connected with the other of said inner race member and said outer race member, and said second end of said outer propeller shaft being structured to receive said propeller;

a thrust bearing connected with said outer propeller shaft;

an outer thrust housing connected with said thrust bearing and rotatably supporting said outer propeller shaft;

an inner thrust housing connected to said hull of said boat, said inner thrust housing pivotably supporting said outer thrust housing about a substantially vertical pivot axis, said inner thrust housing having an annulus into which said inner propeller shaft is at least in part located;

a skag plate attached to said outer thrust housing and pivotable therewith, said skag plate extending downward from said outer thrust housing and forward of said vertical pivot axis;

means for transmitting torque from said marine power plant to said propeller; and means for articulating said outer thrust housing with respect to said inner thrust housing.

8. The marine propeller drive system of claim 7, wherein said propeller has an axially splined mounting bore, said means for transmitting torque comprising:

first splines on said one of said inner race member and said outer race member;

second splines on said second end of said inner propeller shaft, said first and second splines slidably meshing to permit said one of said inner race member and said outer race member to move axially with respect to said inner propeller shaft; and third splines on said second end of said outer propeller shaft meshing with said axially splined mounting bore of said propeller.

9. The marine propeller drive system of claim 8, wherein said means for articulating comprises:

a steering shaft hub provided on said inner thrust housing; and a steering shaft connected to said outer thrust housing, said steering shaft being rotatably mounted to said steering shaft hub concentric with said vertical pivot axis.

10. The marine propeller drive system of claim 9, wherein said boat further has a transom, said inner thrust housing extends through said transom and is connected to said hull.

11. The marine propeller drive system of claim 10, wherein said inner race member is connected with said second end of said inner propeller shaft; further wherein said outer race member is connected with said first end of said outer propeller shaft.

12. The marine propeller drive system of claim 9, wherein said inner thrust housing extends through the bottom of said hull in axial alignment therewith.

13. A boat and marine propeller drive system comprising:

a boat having a hull and a transom;

a marine power plant disposed in said boat;

an inner propeller shaft having a first end and a second end, said first end of said inner propeller shaft being connected to said marine power plant;

a constant velocity universal joint having an inner race member and an outer race member, one of said inner race member and said outer race member being connected with said second end of said inner propeller shaft;

an outer propeller shaft having a first end and a second end, said first end of said outer propeller shaft being connected with the other of said inner race member and said outer race member;

a propeller removably connected to said second end of said outer propeller shaft;

a thrust bearing connected to said outer propeller shaft;

an outer thrust housing connected to said thrust bearing and enclosing a portion of said outer propeller shaft;

an inner thrust housing having one end pivotably connected to said outer thrust housing about a substantially vertical axis and the other end attached to said hull, said inner thrust housing having an annulus into which said inner propeller shaft is at least in part located;

a skag plate connected to said outer thrust housing, said skag plate extending downward from the bottom of said outer thrust housing and forward of said substantially vertical axis below said inner thrust housing;

means for transmitting torque from said marine power plant to said propeller; and means for angularly displacing said outer thrust housing with respect to said inner thrust housing about said substantially vertical axis.

14. The boat and marine propeller drive system of claim 13, wherein said propeller has an axially located splined mounting bore, said means for transmitting torque comprising:

first splines on said one of said inner race member and said outer race member;

second splines on said second end of said inner propeller shaft, said first and second splines gearingly meshing to permit said inner propeller shaft to move axially with respect to said one of said inner race member and said outer race member; and third splines on said second end of said outer propeller shaft for gearingly meshing with said axially located splined mounting bore of said propeller.

15. The boat and marine propeller drive system of claim 14, wherein said means for angularly displacing comprises:

a steering shaft hub provided on said inner thrust housing; and a steering shaft rotatably connected to said steering shaft hub concentric with said substantially vertical axis, said steering shaft having one end connected to said outer thrust housing, said outer thrust housing being rotatable relative to said inner thrust housing with the rotation of said steering shaft.

16. The boat and marine propeller drive system of claim 15, wherein said inner thrust housing is mounted to said hull of said boat through said transom; said thrust being delivered by said inner thrust housing to said hull in axial alignment with said inner propeller shaft.

17. The boat and marine propeller drive system of claim 15, wherein said inner thrust housing is mounted to said boat through said hull, said thrust being delivered by said inner thrust housing to said hull in axial alignment with said inner propeller shaft.

18. A marine propeller drive system for a boat, said boat having a hull, a marine power plant and a propeller for producing thrust, comprising:

an inner propeller shaft having a first end and a second end, said first end of said inner propeller shaft being connectable to said marine power plant;

a universal joint having a first end and a second end, said first end being articulatable with respect to said second end about an axis of articulation, said second end of said inner propeller shaft being connected with said first end of said universal joint;

an outer propeller shaft having a first end and a second end, said first end of said outer propeller shaft being connected with said second end of said universal joint, said second end of said outer propeller shaft being structured to removably receive said propeller;

means for transmitting a torque from said marine power plant to said propeller;

means for transmitting a thrust generated by said propeller to said boat, said thrust being transmitted so as to bypass at least said first end of said universal joint and said inner propeller shaft, said thrust being delivered to said hull, said thrust further being delivered to said boat in axial alignment with said inner propeller shaft;

means for articulating said outer propeller shaft with respect to said inner propeller shaft about a substantially vertical axis of articulation of said universal joint; and a skag plate coupled to said means for transmitting a thrust, said skag plate extending below said inner propeller shaft and extending forward of said substantially vertical axis of articulation of said universal joint.

19. The marine propeller drive system of claim 18, wherein said means for transmitting a thrust comprises:

a thrust bearing connected to said outer propeller shaft;

an outer thrust housing connected to said thrust bearing and circumscribing a portion of said outer propeller shaft; and an inner thrust housing having one end pivotably connected to said outer thrust housing about said substantially vertical axis of articulation and the other end connected to said hull, said inner thrust housing partially enclosing said inner propeller shaft.

20. The marine propeller drive system of claim 19, wherein said propeller has an axially located splined mounting bore, said means for transmitting a torque comprising:

first splines on said first end of said universal joint;

second splines on said second end of said inner propeller shaft, said first and second splines gearingly meshing and permitting said inner propeller shaft to move axially with respect to said first end of said universal joint; and third splines on said second end of said outer propeller shaft gearingly meshing with said axially located splined mounting bore of said propeller.

21. The marine propeller drive system of claim 20, wherein said means for articulating comprises:

a steering shaft hub provided on said inner thrust housing; and a steering shaft rotatably mounted on said steering shaft hub concentric with said substantially vertical axis of articulation, said steering shaft being fixedly connected to said outer thrust housing and adapted to rotate said outer thrust housing relative to said inner thrust housing about said substantially vertical axis of articulation.

22. The marine propeller drive system of claim 21, wherein said boat has a transom, said inner propeller shaft and said inner thrust housing being mounted to said boat through said transom.

23. The marine propeller drive system of claim 22, wherein said skag plate is connected to said outer thrust housing and rotatably supported from said inner thrust housing.

24. The marine propeller drive system of claim 21, wherein said inner housing propeller shaft and said inner housing are mounted to said boat through said hull.

25. The marine propeller drive system of claim 24, wherein said skag plate is connected to said outer thrust housing and rotatably supported from said inner thrust housing.

* * * * *

UNITED STATES PATENT AND TRADEMARK OFFICE

CERTIFICATE OF CORRECTION

PATENT NO. : 4,929,203

DATED : May 29, 1990

INVENTOR(S) : Steven C. Hahn

It is certified that error appears in the above-identified patent and that said Letters Patent is hereby corrected as shown below:

Column 1, line 20, delete "respectivelyl" and insert ---- respectively ----.

Column 8, line 39, before "hub" insert ---- shaft ----.

Signed and Sealed this

Twentieth Day of August, 1991

*Attest:*

*Attesting Officer*

HARRY F. MANBECK, JR.

*Commissioner of Patents and Trademarks*